US010337302B2

(12) United States Patent
Roth et al.

(10) Patent No.: US 10,337,302 B2
(45) Date of Patent: Jul. 2, 2019

(54) IN-SITU REPLACEMENT OF FLUIDS IN A WELL TOOL

(71) Applicant: Saudi Arabian Oil Company, Dhahran (SA)

(72) Inventors: Brian A. Roth, Dhahran (SA); Jinjiang Xiao, Dhahran (SA); Rafael Adolfo Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 138 days.

(21) Appl. No.: 15/450,826

(22) Filed: Mar. 6, 2017

(65) Prior Publication Data

US 2018/0252081 A1 Sep. 6, 2018

(51) Int. Cl.

| | |
|---|---|
| ***E21B 43/12*** | (2006.01) |
| ***E21B 34/02*** | (2006.01) |
| ***E21B 17/18*** | (2006.01) |
| ***E21B 23/01*** | (2006.01) |

(52) U.S. Cl.

CPC ..... *E21B 43/128* (2013.01); *E21B 17/18* (2013.01); *E21B 23/01* (2013.01); *E21B 34/02* (2013.01); *E21B 43/129* (2013.01)

(58) Field of Classification Search

CPC ..... E21B 43/128; E21B 17/18; E21B 23/01; E21B 34/02; E21B 43/129

See application file for complete search history.

(56) References Cited

U.S. PATENT DOCUMENTS

| | | | | |
|---|---|---|---|---|
| 4,476,923 | A * | 10/1984 | Walling | H01B 7/0072 166/105 |
| 5,146,982 | A | 9/1992 | Dinkins | |
| 5,191,173 | A | 3/1993 | Sizer et al. | |
| 5,375,656 | A | 12/1994 | Wilson | |
| 6,666,664 | B2 | 12/2003 | Gross | |
| 8,322,444 | B2 | 12/2012 | De Camargo | |
| 2010/0051282 | A1 * | 3/2010 | Gaudette | E21B 43/129 166/312 |
| 2014/0174756 | A1 * | 6/2014 | Sakamoto | E21B 43/126 166/372 |
| 2015/0068769 | A1 * | 3/2015 | Xiao | E21B 43/12 166/382 |
| 2015/0101791 | A1 | 4/2015 | Chalifoux | |

(Continued)

FOREIGN PATENT DOCUMENTS

CA 2890974 A1 1/1999

OTHER PUBLICATIONS

International Search Report and Written Opinion for International Application No. PCT/US2018/021009, dated Jun. 18, 2018 (pp. 1-15).

*Primary Examiner* — Yong-Suk Ro

(74) *Attorney, Agent, or Firm* — Bracewell LLP; Constance G. Rhebergen; Linda L. Morgan

(57) ABSTRACT

An assembly for circulating tool fluid of a downhole tool includes a tool fluid source line extending into a subterranean well from a wellhead spool assembly to the downhole tool. A tool fluid return line extends out of the subterranean well from the downhole tool to the wellhead spool assembly. A tool fluid reservoir is located at a surface outside of the subterranean well. The tool fluid source line is in one way fluid communication with the tool fluid reservoir and the tool fluid is free of fluid communication with wellbore fluids.

27 Claims, 4 Drawing Sheets

(56) References Cited

U.S. PATENT DOCUMENTS

| | | | | |
|---|---|---|---|---|
| 2015/0226208 | A1* | 8/2015 | Shaw | E21B 43/129<br>417/377 |
| 2016/0047210 | A1 | 2/2016 | Pinkston | |
| 2016/0109063 | A1 | 4/2016 | Berry | |

* cited by examiner

IN-SITU REPLACEMENT OF FLUIDS IN A WELL TOOL

BACKGROUND

1. Field of the Disclosure

The present technology relates to oil and gas production. In particular, the present technology relates to the in-situ replacement of fluids within well tools used in subterranean wells.

2. Description of the Related Art

In many wells, the pressure within the well is sufficient that producing oil and gas from the well requires only the installation of a production tree, and the opening of valves on the tree to allow the oil and gas to flow out of the well. In some instances, however, the pressure in the well is not sufficient to produce the oil and gas at acceptable rates. In such circumstances, it can be necessary to add an artificial lift mechanism, such as an electrical submersible pump (ESP), to help lift the oil and gas from the well. Furthermore, in some circumstances, a well that initially has sufficient pressure to produce without artificial lift may experience a decrease in well pressure, thereby arriving at a point where artificial lift is required.

A motor, pump, and protector, coupled together to make up the basic electrical submersible pump system. Motors are filled with dielectric fluid to provide lubrication to bearings and to provide a means to transfer heat away from the motor. The protector provides a reservoir for the oil volume expansion due to changes in temperature. In current electrical submersible pump systems, although there is some slight leakage of the motor oil through rotary seals in the protector, the motor oil can be considered a closed system in that motor oil is unable to be replaced downhole. Over the life of the electrical submersible pump, which can be several years, the motor oil is not replaced. The motor oil can degrade in place due to temperature and/or contaminants caused by motor wear. There is no maintenance performed on these electrical submersible pumps while they are in service.

In addition to electrical submersible pumps, there are of other downhole tools used for hydrocarbon development or production operation that include motors or other components that utilize fluids for actuation, cooling, lubrication, or other known uses.

SUMMARY OF THE DISCLOSURE

Systems and methods of this disclosure provide systems and methods for circulating fluids of a downhole tool from a surface reservoir for providing or replacing the tool fluid without retrieving the tool to the surface.

As an example, this disclosure provides systems and methods for flushing the dielectric motor oil from the downhole motor in-situ. While the disclosure describes replacing fluids in an electrical submersible pump system, the systems and methods disclosed can be used to replace fluids in other well tools.

In an embodiment of this disclosure, an assembly for circulating tool fluid of a downhole tool includes a tool fluid source line extending into a subterranean well from a wellhead spool assembly to the downhole tool. A tool fluid return line extends out of the subterranean well from the downhole tool to the wellhead spool assembly. A tool fluid reservoir is located at a surface outside of the subterranean well. The tool fluid source line is in one way fluid communication with the tool fluid reservoir. The tool fluid is free of fluid communication with wellbore fluids. The wellhead spool assembly can include a master valve used to control the produced hydrocarbons located along a generally horizontally oriented pipeline. The tool fluid source line and tool fluid return line can extend through a wellhead cap axially aligned with the subterranean well.

In alternate embodiments, the tool fluid reservoir can be sealed from the environment. The wellhead spool assembly can include a spool body with a spool body side opening and a cable hanger having a vertical penetrator that is landed within the spool body so that a hanger side opening of the cable hanger is aligned with the spool body side opening. A horizontal penetrator can extend through the hanger side opening and the spool body side opening and sealingly engaging the vertical penetrator.

In other alternate embodiments, a conduit can extend from the wellhead spool assembly to the downhole tool, the conduit including tool fluid source line, tool fluid return line. A surface pump can be located at the surface drawing tool fluid from the tool fluid reservoir and directing the tool fluid in a direction towards the downhole tool. A sample valve can be in fluid communication with the tool fluid return line.

In an alternate embodiment of this disclosure, an assembly for circulating tool fluid of a downhole tool includes a tool fluid source line extending into a subterranean well from a wellhead spool assembly to the downhole tool, wherein the downhole tool is an electrical submersible pump assembly. A tool fluid return line extends out of the subterranean well from the downhole tool to the wellhead spool assembly. A tool fluid reservoir is located at a surface outside of the subterranean well, wherein the tool fluid is a dielectric fluid and the tool fluid reservoir contains a volume of the dielectric fluid. A conduit supports the downhole tool within the subterranean well. Both the tool fluid source line and the tool fluid return line extend through the conduit. The tool fluid is free of fluid communication with wellbore fluids.

In alternate embodiments, the wellhead spool assembly can include a spool body with a spool body side opening, a cable hanger that is landed within the spool body so that a hanger side opening of the cable hanger is aligned with the spool body side opening, the cable hanger having a vertical penetrator, and a horizontal penetrator extending through the hanger side opening and the spool body side opening and sealingly engaging the vertical penetrator.

In other alternate embodiments, a conduit connector can be sealingly attached to the vertical penetrator, the conduit connector secured to the conduit so that the cable hanger supports a load of the downhole tool within the subterranean well. The conduit can include electrical lines. The electrical submersible pump assembly can include a sump and the sump can be located below a connection of the tool fluid return line to the electrical submersible pump assembly. A surface pump can be located at the surface drawing tool fluid from the tool fluid reservoir and directing the tool fluid in a direction towards the downhole tool. The electrical submersible pump assembly can be free of a protector section. The wellhead spool assembly includes a master valve used to control the produced hydrocarbons located along a generally horizontally oriented pipeline. The tool fluid source line and tool fluid return line can extend through a wellhead cap axially aligned with the subterranean well.

In another alternate embodiment of this disclosure, a method for circulating a tool fluid of a downhole tool includes extending a tool fluid source line into a subterranean well from a wellhead spool assembly to the downhole tool. A tool fluid return line is extended out of the subterranean well from the downhole tool to the wellhead spool assembly. A tool fluid reservoir is located at a surface outside of the subterranean well. The tool fluid source line is in one way fluid communication with the tool fluid reservoir and the tool fluid is free of fluid communication with wellbore fluids.

In alternate embodiments, the wellhead spool assembly can include a spool body with a spool body side opening, and the method can further include landing a cable hanger having a vertical penetrator within the spool body so that a hanger side opening of the cable hanger is aligned with the spool body side opening, extending a horizontal penetrator through the hanger side opening and the spool body side opening, and sealingly engaging the vertical penetrator with the horizontal penetrator.

In other alternate embodiments, the method can further include securing a conduit connector of the vertical penetrator to a conduit so that the cable hanger supports a load of the downhole tool within the subterranean well, the conduit connector being sealingly attached to the vertical penetrator. The downhole tool can be supported with a conduit extending from the wellhead spool assembly to the downhole tool, the conduit including the tool fluid source line, and the tool fluid return line. Tool fluid can be pumped from the tool fluid reservoir and towards the downhole tool with a surface pump located at the surface. The tool fluid can be sampled from the tool fluid return line with a sample valve in fluid communication with the tool fluid return line. The downhole tool can be an electrical submersible pump assembly, the tool fluid can be a dielectric fluid, and the tool fluid reservoir can contain a volume of the dielectric fluid. Power can be provided to the electrical submersible pump assembly with electrical lines within a conduit extending from the wellhead spool assembly to the downhole tool, the conduit also including the tool fluid source line, and the tool fluid return line. The electrical submersible pump assembly can be free of a protector section

BRIEF DESCRIPTION OF THE DRAWINGS

The present technology will be better understood on reading the following detailed description of nonlimiting embodiments thereof, and on examining the accompanying drawings, in which.

DETAILED DESCRIPTION

Figure 1:
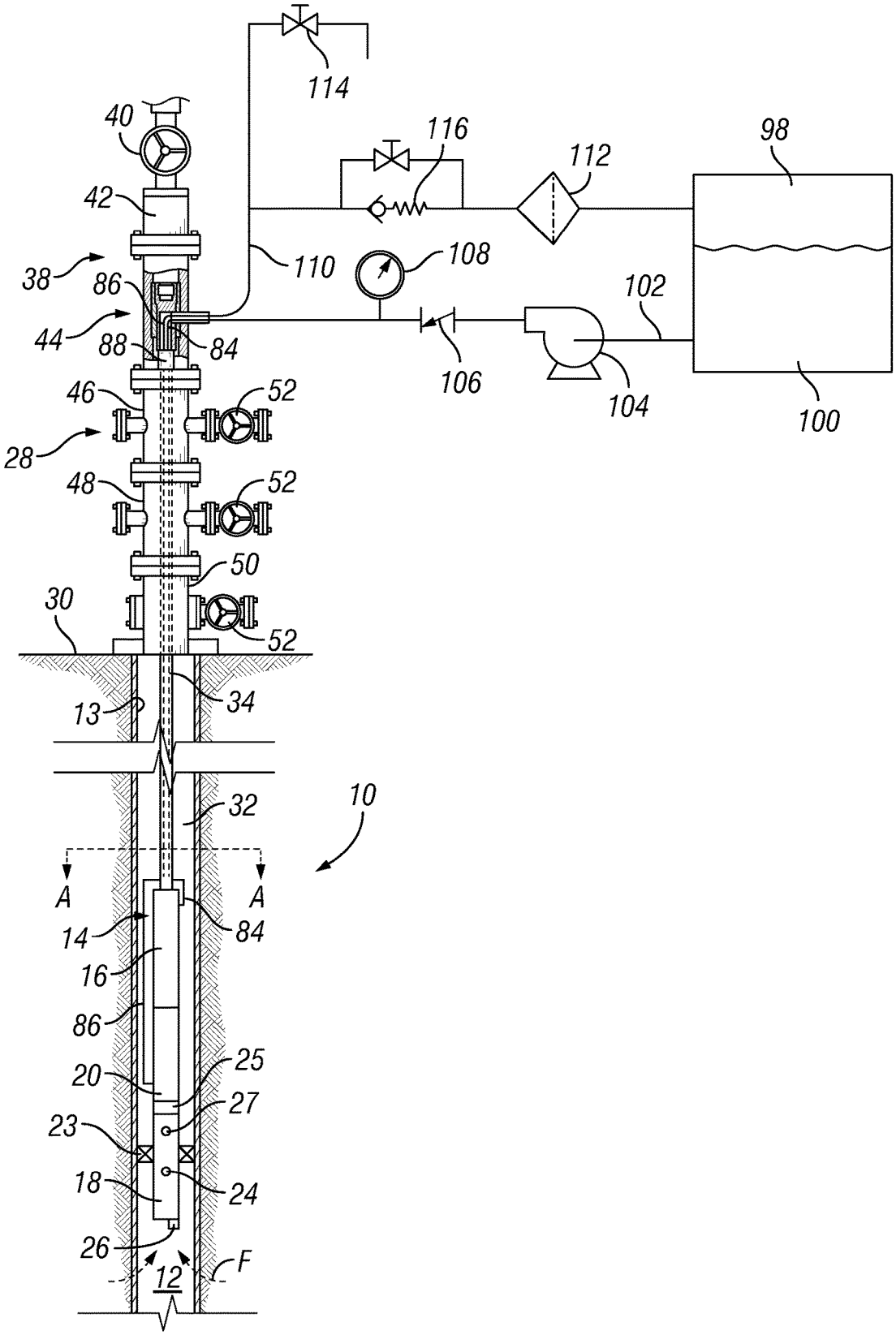
FIG. 1 is a schematic section view of a subterranean well with a wellhead assembly having a vertical tree configuration with an assembly for circulating tool fluid of a downhole tool, in accordance with an embodiment of this disclosure.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

Looking at FIG. 1, subterranean well 10 includes wellbore 12. Wellbore 12 can be lined with tubing or casing 13. A downhole tool, such as electrical submersible pump assembly 14 is located within wellbore 12. Although the downhole tool is described in this disclosure as being an electrical submersible pump assembly, the downhole tool can alternately be other known tools used within wellbores in the industry. Examples of other such downhole tools and devices include heater cables for gas well deliquidification, alternative types of artificial lift systems, such as progressive cavity pumps, and systems for monitoring well parameters, such as temperature, pressure, and corrosion. For ease of discussion, an electrical submersible pump assembly is discussed in this disclosure in describing the technology, but the technology is not limited to use with an electrical submersible pump assembly.

Electrical submersible pump assembly 14 includes motor 16 that is used to drive a pump 18. Between motor 16 and pump 18 is seal section 20 for equalizing pressure within electrical submersible pump assembly 14 with that of wellbore 12 can include a thrust bearing chamber to accommodate the pump thrust. Below seal section 20 is fluid sump 25 to capture small particles that may be lost during wear of the thrust bearing or motor 16 components.

Sensor 26 can be included in electrical submersible pump assembly 14. In the example embodiment of FIG. 1, sensor 26 is located at a lower end of electrical submersible pump assembly 14. Sensor 26 can gather and provide data relating to operations of electrical submersible pump assembly 14 and conditions within wellbore 12. As an example, sensor 26 can monitor and report pump 18 intake pressure and temperature, pump 18 discharge pressure and temperature, motor 16 oil and motor 16 winding temperature, vibration of electrical submersible pump assembly 14 in multiple axis, and any leakage of electrical submersible pump assembly 14. Although electrical submersible pump assembly 14 is shown as an inverted type with motor 16 closer to the top and pump 18 closer to the bottom. Alternative embodiments can be similarly accomplished with a conventional style electrical submersible pump assembly 14 set up with motor 16 closer to the bottom and pump 18 closer to the top.

Fluid F is shown entering wellbore 12 from a formation adjacent wellbore 12. Fluid F flows to inlet 24 formed in the housing of pump 18. Fluid F is pressurized within pump 18, flows out of outlet 27, and travels up to wellhead assembly 28 at surface 30 through tubing casing annulus 32. A seal member 23 such as a packer circumscribes electrical submersible pump assembly 14 between inlet 24 and outlet 27 to isolate inlet 24 from outlet 27. Electrical submersible pump assembly 14 is suspended within wellbore 12 with conduit 34. Conduit 34 is a power conduit that includes electrical lines 36 (FIGS. 3-4) for providing power to motor 16. Electrical lines 36 extend from wellhead assembly 28 to motor 16 within conduit 34.

Wellhead assembly 28 includes vertical production tree 38. Vertical production tree 38 has a master valve 40 which is positioned above a tubing bonnet 42. Tubing bonnet 42 is attached to wellhead spool assembly 44, the structure of which is shown in greater detail in FIG. 2, and which is capable of allowing passage of electrical submersible pump assembly 14 or other downhole too in to wellbore 12 without removal of the vertical production tree 38.

Looking at FIG. 1, below wellhead spool assembly 44 are additional components that are part of vertical production tree 38, such as, for example, tubing spool 46, a casing spool 48, and a casing heel 50. For simplifying the schematic figure, the casing and tubing that extend from vertical production tree 38 into wellbore 12 are not shown in FIG. 1. Various control valves 52 are positioned on the vertical production tree 38 to regulate the flow of liquids into and out of the tree as required by production operations.

Figure 2:
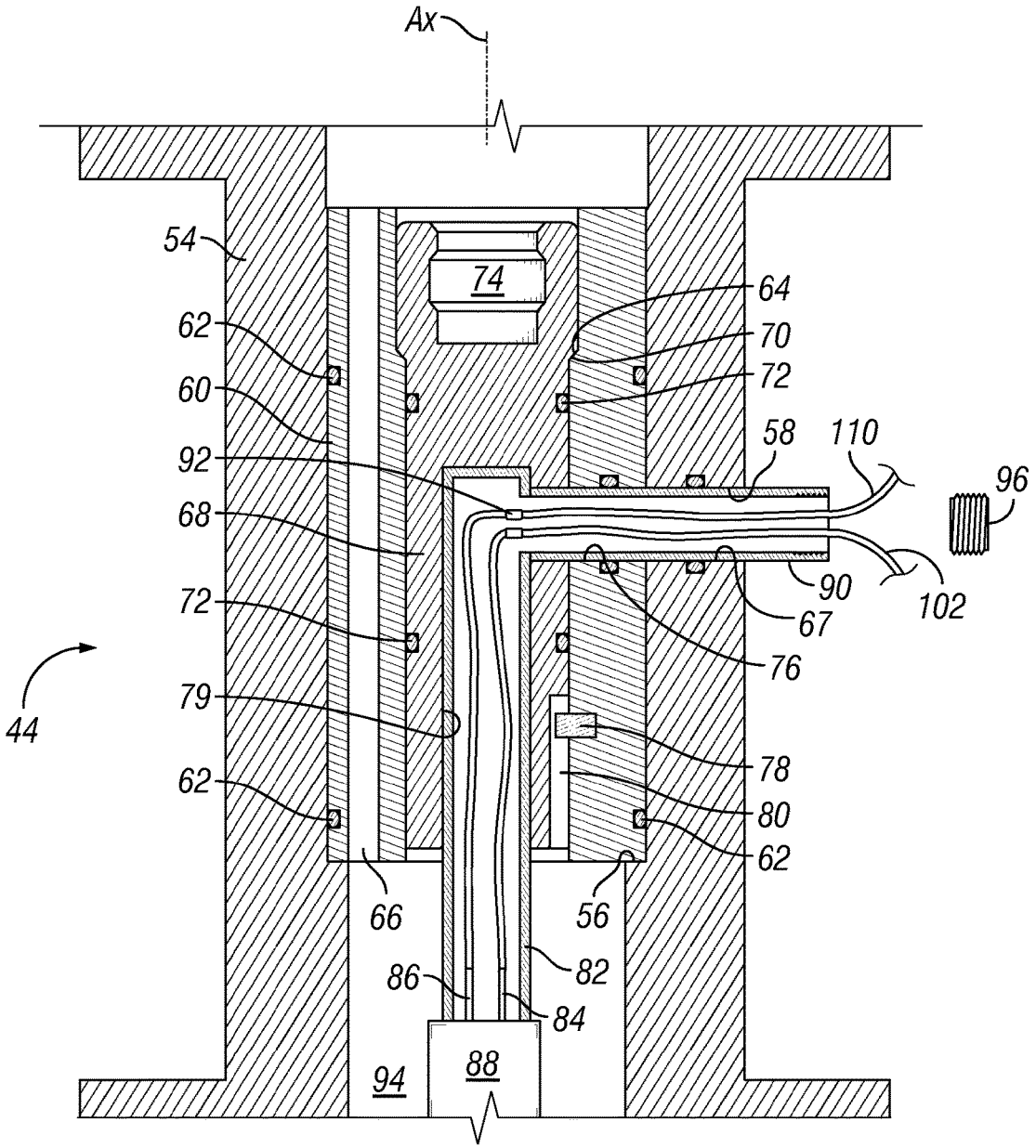
FIG. 2 is a section view of a wellhead spool and hanger assembly of a vertical tree configuration in accordance with an embodiment of this disclosure.

Looking at FIG. 2, wellhead spool assembly 44 includes spool body 54 with a piping spool shoulder 56 and spool body side opening 58. Piping spool shoulder 56 is defined where an inner diameter of spool body 54 reduces to form a ledge. Spool body side opening 58 projects radially through a side wall of the spool body 54 above the piping spool shoulder 56.

Annular fluid bypass member 60 is positioned coaxially within the main bore of spool body 54 so that when fluid bypass member 60 is positioned within the spool body 54, a bottom end of fluid bypass member 60 lands on and is supported by piping spool shoulder 56. Seals 62 seal the interface between the spool body 54 and fluid bypass member 60. The inner diameter of the fluid bypass member 60 is large enough to allow the passage of electrical submersible pump assembly 14. Fluid bypass member 60 further includes fluid bypass member shoulder 64 on the inner surface of an inner bore of fluid bypass member 60. In some embodiments, spool body 54 and fluid bypass member 60 can be one integral piece.

Fluid bypass member 60 includes at least one production port 66, shown formed axially through fluid bypass member 60 and offset from Axis Ax of fluid bypass member 60, which provides a path for oil, gas, and other fluids to pass from below the wellhead spool assembly 44 to above the wellhead spool assembly 44. In alternate embodiments, there can be multiple production ports. The cross-sectional area of the production port 66, or the aggregate cross-sectional area of the multiple production ports, as the case may be, is large enough to keep the flow velocity of the fluids through the ports below a threshold specified by industrial standards.

Fluid bypass member 60 further includes fluid bypass member side opening 67 that extends radially through a side wall of fluid bypass member 60. Fluid bypass member side opening 67 is sized and positioned to align with spool body side opening 58.

Cable hanger 68 is adapted for insertion in the fluid bypass member 60. Cable hanger 68 has an outer diameter that transitions inward to define a downward facing cable hanger lip 70, shown landed on the upward facing fluid bypass member shoulder 64. The interaction between the fluid bypass member shoulder 64 and the cable hanger lip 70 supports cable hanger 68 in vertical production tree 38, and limits its downward movement relative to the fluid bypass member 60. Seals 72 seal the interface between the inner surface of fluid bypass member 60 and the outer surface of cable hanger 68.

Cable hanger 68 of FIG. 2 also includes a latch 74 at an upper end thereof that is shaped to releasably connect with a running tool (not shown). During makeup of wellhead spool assembly 44, and in particular insertion of the cable hanger 68 into fluid bypass member 60, the running tool can be attached to the latch 74 to direct the movement of the cable hanger 68 into wellhead spool assembly 44. When cable hanger 68 is landed, the running tool can then release latch 74 and be removed.

Cable hanger 68 further includes hanger side opening 76 and vertical bore 79 that intersects hanger side opening 76. Hanger side opening 76 is sized and positioned to align with fluid bypass member side opening 67 and spool body side opening 58 so that vertical bore 79 registers with hanger side opening 76, fluid bypass member side opening 67, and spool body side opening 58. To ensure that the hanger side opening 76, fluid bypass member side opening 67, and spool body side opening 58 align, upon insertion of the cable hanger 68, self-orienting mechanisms can be provided in wellhead spool assembly 44. For example, in the embodiment shown in FIG. 2, self-orienting pin 78 can be included in the inner sidewall of the fluid bypass member 60, and can protrude inwardly from the inner surface of the fluid bypass member 60. In addition, self-orienting pin receiving slot 80 can be cut in a portion of the outer surface of cable hanger 68. When cable hanger 68 is inserted into fluid bypass member 60, unless self-orienting pin 78 and self-orienting pin receiving slot 80 are aligned, cable hanger 68 cannot fully insert into fluid bypass member 60. Instead, the bottom of the cable hanger 68 will contact self-orienting pin 78 rather than the self-orienting pin 78 being inserted into self-orienting pin receiving slot 80.

Cable hanger 68 includes vertical penetrator 82 that extends axially into the cable hanger 68 from the bottom, and that houses electrical lines 36 (FIG. 4), tool fluid source line 84 and tool fluid return line 86. Vertical penetrator 82 can be separate from cable hanger 68, and can be machined or molded to prevent the ingress of production fluids. Vertical penetrator 82 can be held in place relative to the cable hanger 68 by a shoulder or thread (not shown). Electrical lines 36, tool fluid source line 84 and tool fluid return line 86 extend from wellhead spool assembly 44 downhole through vertical penetrator 82 to conduit connector 88. Conduit connector 88 is sealingly attached to vertical penetrator 82. Conduit connector 88 is secured to conduit 34 so that cable hanger 68 supports a load of the downhole tool within the subterranean well 10.

Conduit connector 88 includes mating connections to allow the portion of electrical lines 36, tool fluid source line 84 and tool fluid return line 86 that are located within vertical penetrator 82 to mate with the portion of electrical lines 36, tool fluid source line 84 and tool fluid return line 86 that are located within conduit 34. Conduit 34 extends to electrical submersible pump assembly 14 and houses electrical lines 36, tool fluid source line 84 and tool fluid return line 86 to provide power, fluids, controls, etc. to electrical submersible pump assembly 14 or other downhole device. 36

Horizontal penetrator 90 extends through hanger side opening 76, fluid bypass member side opening 67, and spool body side opening 58 and sealingly engages vertical penetrator 82 at a side opening of vertical penetrator 82. Horizontal penetrator 90 seals with fluid bypass member 60 and cable hanger 68 and provides access from outside spool body 54 to cable and hydraulic line connections 92. A cable and hydraulic line connection 92 is located at the top end of each of the electrical lines 36 (FIG. 4), the tool fluid source line 84 and the tool fluid return line 86 within vertical penetrator 82. Although not shown in FIG. 2, electrical lines 36 mate with an external power source by way of a cable and hydraulic line connection 92.

Vertical penetrator 82 and horizontal penetrator 90 are sealed from flow area 94 so that cable and hydraulic line connections 92 can be accessed, connections with electrical lines 36, tool fluid source line 84 and tool fluid return line 86 can be made up, and electrical submersible pump assembly 14 can be controlled while oil and gas is being simultaneously produced through production port 66. Before making up connections to electrical lines 36, tool fluid source line 84 and tool fluid return line 86 at cable and hydraulic line connections 92, plug or cap 96 that can be inserted into an end of horizontal penetrator 90 to cover and electrically protect cable and hydraulic line connections 92.

Figure 3:
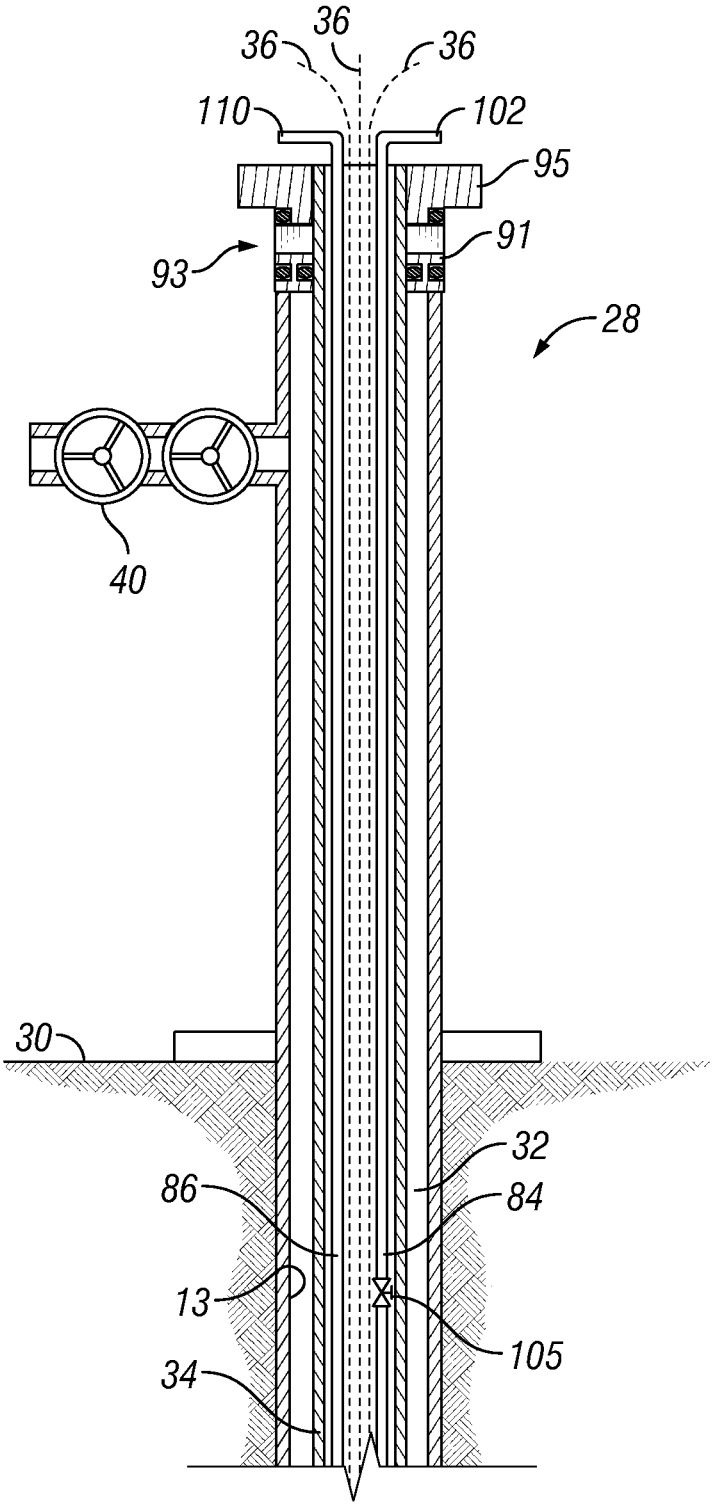
FIG. 3 is a section view of a wellhead assembly with a horizontal tree configuration in accordance with an embodiment of this disclosure.
Figure 4:
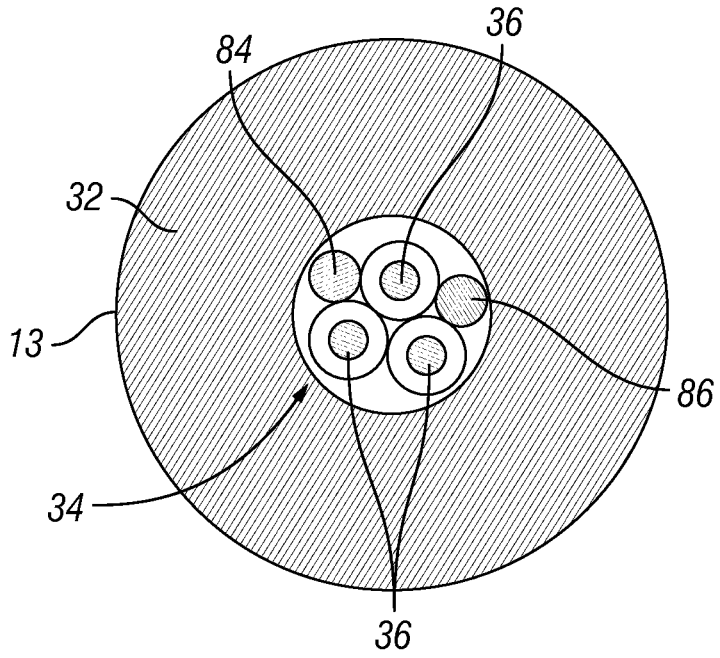
FIG. 4 is a cross section view of a conduit along section lines A-A of FIG. 1, in accordance with an embodiment of this disclosure.

In the alternate embodiment of FIG. 3, wellhead assembly 28 has a horizontal tree configuration. In a horizontal tree configuration, master valve 40 used to control the produced hydrocarbons is located along a generally horizontally oriented pipeline. In such a configuration, conduit 34 sealingly engages lower barrier 91 of wellhead cap 93. Electrical lines 36 further extend out of upper barrier 95 of wellhead cap 93 to be connected with the external power source. Wellhead cap 93 is axially aligned with subterranean well 10.

Looking at FIG. 1, the example assembly for circulating tool fluid 100 of a downhole tool includes tool fluid reservoir 98 located at surface 30 outside of subterranean well 10. Tool fluid reservoir 98 is sealed from the environment to prevent contamination of tool fluid 100, including absorption of atmospheric water into the tool fluid 100. Tool fluid reservoir 98 contains a volume of tool fluid 100. Tool fluid 100, can be, for example, a hydraulic fluid, a dielectric fluid, or other fluid used in conjunction with a downhole tool.

Surface source line 102 extends from tool fluid reservoir 98 to wellhead spool assembly 44. Surface source line 102 is in fluid communication with tool fluid source line 84 at cable and hydraulic line connections 92 of FIG. 2. In the example embodiment of FIG. 3, tool fluid source line 84 extends through wellhead cap 93 and surface source line 102 can be in fluid communication with tool fluid source line 84 at wellhead cap 93. Tool fluid 100 is pumped from tool fluid reservoir 98 with surface pump 104. Surface pump 104 can be, for example, a positive displacement pump or other known pump type used in the industry. Surface pump 104 can draw tool fluid 100 from tool fluid reservoir 98 and direct tool fluid 100 in a direction towards the downhole tool. Tool fluid 100 can pass through source check valve 106 that is located along surface source line 102 between fluid reservoir 98 and wellhead spool assembly 44. Source check valve 106 can be prevent backflow of tool fluid 100 from wellhead spool assembly into tool fluid reservoir in surface source line 102 so that tool fluid source line 84 is in one way fluid communication with tool fluid reservoir 98. Pressure gauge 108 can monitor the pressure of tool fluid 100 in surface source line 102. In order to restrict a high pressure event in tool fluid source line 84, at least one pressure control device 105 (FIG. 3) can be installed in-line with tool fluid source line 84 below wellhead assembly 28. Pressure control device 105 will allow low oil injection rates from surface pump 104 but will restrict higher flow rates or pressure from the well in case of a breach in tool fluid source line 84. Pressure control device 105 can be either pressure or flow activated and controlled.

Tool fluid 100 will flow downhole through tool fluid source line 84 enter electrical submersible pump assembly 14 at motor 16. In certain embodiments, tool fluid 100 will enter motor 16 at an upper region of motor 16 and can fill motor 16 with tool fluid 100. Tool fluid 100 will travel downward and flood the bearing chamber of seal section 20.

Tool fluid 100 will return from electrical submersible pump assembly 14 by way of tool fluid return line 86. Tool fluid return line 86 will exit seal section 20 above sump 25 to prevent debris that is located within sump 25 from clogging tool fluid return line 86. Tool fluid return line 86 extends through conduit 34 from electrical submersible pump assembly 14 to wellhead spool assembly 44. Tool fluid return line 86 is in fluid is in fluid communication with surface return line 110 at cable and hydraulic line connections 92 of FIG. 2. In the example embodiment of FIG. 3, tool fluid return line 86 extends through wellhead cap 93 and surface return line 110 can be in fluid communication with tool fluid return line 86 at wellhead cap 93. Tool fluid 100 can be returned to tool fluid reservoir 98 or can be discarded and new tool fluid 100 can be added to tool fluid reservoir 98. If tool fluid 100 is returned to tool fluid reservoir 98, tool fluid can first pass through filter 112 to clean micro particulates from tool fluid 100. Tool fluid 100 returned to tool fluid reservoir 98 can pass through return check valve 116 that is located along surface return line 110. Return check valve 116 can be prevent the backflow of tool fluid 100 towards electrical submersible pump assembly 14 so that tool fluid return line 86 is in one way fluid communication with tool fluid reservoir 98.

Tool fluid 100 returned through surface return line 110 can be sampled and tested through sample valve 114 to test for tool fluid degradation. Sample valve 114 is in fluid communication with fluid return line 86 by way of surface return line 110. The results of such testing can assist in determining the health of electrical submersible pump assembly 14 or the need to replace tool fluid 100.

Both tool fluid source line 84 and tool fluid return line 86 are sealed at any connection points so that tool fluid 100 cannot mix with wellbore fluids located within wellbore 12. From wellhead spool assembly 44 to electrical submersible pump assembly 14 and back to wellhead spool assembly 44 tool fluid 100 travels through a closed system that is sealed from wellbore fluids and free of valves or openings that would allow tool fluid 100 to be in fluid communication with wellbore fluids.

The use of the circulation system having both source and return lines provides a balanced hydrostatic force that reduces complexity and improves the reliability of the downhole tool over current systems. A slight positive pressure can be applied to the system and blocked in to provide a means to observe leakage on the thrust bearing rotary shaft seals. In addition, if the blocked in pressure on the system reduces, pump 104 can be automated to provide additional tool fluid 100 to the system and boost the hydraulic pressure back to the slight positive pressure.

In certain embodiments, the circulation of tool fluid 100 can be a continuous process which would provide an additional benefit of cooling motor 16. Alternately, tool fluid 100 can be changed out periodically to prevent fluid degradation. Alternate embodiments may include a heat exchanger (not shown) at surface 30 to cool tool fluid 100, providing additional cooling to motor 16. Other alternate embodiments may include sensors, such as temperature and pressure transducers, and can utilize control algorithms to optimize the tool fluid circulation process.

Embodiments of this disclosure therefore provide a fluid reservoir at a surface with the tool fluid being circulated downhole and returned to the surface so that tool fluid can be flushed and replaced in-situ. The return line enables sampling of the downhole dielectric fluid for degradation. In the example embodiment, the tool fluid is conveyed to motor 16 of electrical submersible pump assembly 14 by way of a rigless-deployed conduit 34. Because the circulation system provide the ability to replace tool fluid downhole as well as provide for a means for fluid expansion due to temperature changes, a protector is not necessary in the electrical submersible pump assembly.

In addition, embodiments described herein can reduce the need to replace vertical wellheads with horizontal wellheads in order to introduce a downhole tool, such as an electrical submersible pump assembly or other device into a well through the wellhead. Instead, the technology of the present application allows for retrofitting existing vertical wellheads. This can be beneficial particularly in established oil fields, where vertical wellheads may already be in use, and replacement with horizontal wellheads would be costly and inefficient. Alternately, embodiments described herein can be used with traditional horizontal wellheads.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

What is claimed is:

1. An assembly for circulating tool fluid of a downhole tool, the assembly including:

a tool fluid source line extending into a subterranean well from a wellhead spool assembly to the downhole tool;

a tool fluid return line extending out of the subterranean well from the downhole tool to the wellhead spool assembly; and a tool fluid reservoir located at a surface outside of the subterranean well; wherein the tool fluid source line is in one way fluid communication with the tool fluid reservoir;

the tool fluid source line and the tool fluid return line extend within production tubing, defining an annular tubing casing annulus operable for the delivery of production fluids to the wellhead spool assembly; and the tool fluid is free of fluid communication with wellbore fluids.

2. The assembly of claim 1, wherein the tool fluid reservoir is sealed from the environment.

3. The assembly of claim 1, wherein the wellhead spool assembly includes a master valve used to control the produced hydrocarbons located along a generally horizontally oriented pipeline.

4. The assembly of claim 1, wherein the tool fluid source line and the tool fluid return line extend out of the production fluids and through a wellhead cap axially aligned with the subterranean well.

5. The assembly of claim 1, wherein the wellhead spool assembly includes a spool body with a spool body side opening and a cable hanger having a vertical penetrator that is landed within the spool body so that a hanger side opening of the cable hanger is aligned with the spool body side opening, where the cable hanger sealingly engages the wellhead spool assembly with interface seals, the interface seals operable to prevent the production fluids from passing between the cable hanger and the wellhead spool assembly.

6. The assembly of claim 5, further including a horizontal penetrator extending through the hanger side opening and the spool body side opening and sealingly engaging the vertical penetrator, and where the tool fluid source line and the tool fluid return line extend through the horizontal penetrator.

7. The assembly of claim 1, further including a conduit extending from the wellhead spool assembly to the downhole tool, the conduit including tool fluid source line, tool fluid return line.

8. The assembly of claim 1, further including a surface pump located at the surface drawing tool fluid from the tool fluid reservoir and directing the tool fluid in a direction towards the downhole tool.

9. The assembly of claim 1, further including a sample valve in fluid communication with the tool fluid return line.

10. An assembly for circulating tool fluid of a downhole tool, the assembly including:

a tool fluid source line extending into a subterranean well from a wellhead spool assembly to the downhole tool, wherein the downhole tool is an electrical submersible pump assembly;

a tool fluid return line extending out of the subterranean well from the downhole tool to the wellhead spool assembly;

a tool fluid reservoir located at a surface outside of the subterranean well, wherein the tool fluid is a dielectric fluid and the tool fluid reservoir contains a volume of the dielectric fluid; and a conduit supporting the downhole tool within the subterranean well the conduit extending within production tubing, defining an annular tubing casing annulus for the delivery of production fluids; wherein both the tool fluid source line and the tool fluid return line extend through the conduit; and the tool fluid is free of fluid communication with wellbore fluids.

11. The assembly of claim 10, wherein the wellhead spool assembly includes:

a spool body with a spool body side opening;

a cable hanger that is landed within the spool body so that a hanger side opening of the cable hanger is aligned with the spool body side opening, the cable hanger having a vertical penetrator; and a horizontal penetrator extending through the hanger side opening and the spool body side opening and sealingly engaging the vertical penetrator; where the cable hanger sealingly engages the wellhead spool assembly with interface seals, the interface seals operable to prevent the production fluids from passing between the cable hanger and the wellhead spool assembly; and the tool fluid source line and the tool fluid return line extend through the horizontal penetrator.

12. The assembly of claim 11, further including a conduit connector sealingly attached to the vertical penetrator, the conduit connector secured to the conduit so that the cable hanger supports a load of the downhole tool within the subterranean well.

13. The assembly of claim 10, wherein the conduit includes electrical lines.

14. The assembly of claim 10, wherein the electrical submersible pump assembly includes a sump, and wherein the sump is located below a connection of the tool fluid return line to the electrical submersible pump assembly.

15. The assembly of claim 10, further including a surface pump located at the surface drawing tool fluid from the tool fluid reservoir and directing the tool fluid in a direction towards the downhole tool.

16. The assembly of claim 10, wherein the electrical submersible pump assembly is free of a protector section.

17. The assembly of claim 10, wherein the wellhead spool assembly includes a master valve used to control the produced hydrocarbons located along a generally horizontally oriented pipeline.

18. The assembly of claim 10, wherein the tool fluid source line and the tool fluid return line extend out of the production fluids and through a wellhead cap axially aligned with the subterranean well.

19. A method for circulating a tool fluid of a downhole tool, the method including:

extending a tool fluid source line into a subterranean well from a wellhead spool assembly to the downhole tool;

extending a tool fluid return line out of the subterranean well from the downhole tool to the wellhead spool assembly wherein the tool fluid source line and the tool fluid return line extend within a conduit located within production tubing, defining an annular tubing casing annulus for the delivery of production fluids; and locating a tool fluid reservoir at a surface outside of the subterranean well; wherein the tool fluid source line is in one way fluid communication with the tool fluid reservoir; and the tool fluid is free of fluid communication with wellbore fluids.

20. The method of claim 19, wherein the wellhead spool assembly includes a spool body with a spool body side opening, the method further including:

landing a cable hanger having a vertical penetrator within the spool body so that the cable hanger sealingly engages the wellhead spool assembly with interface seals, the interface seals preventing the production fluids from passing between the cable hanger and the wellhead spool assembly, and so that a hanger side opening of the cable hanger is aligned with the spool body side opening;

extending a horizontal penetrator through the hanger side opening and the spool body side opening, and sealingly engaging the vertical penetrator with the horizontal penetrator;

and extending the tool fluid source line and the tool fluid return line through the horizontal penetrator.

21. The method of claim 20, further including securing a conduit connector of the vertical penetrator to the conduit so that the cable hanger supports a load of the downhole tool within the subterranean well, the conduit connector being sealingly attached to the vertical penetrator.

22. The method of claim 19, supporting the downhole tool with the conduit extending from the wellhead spool assembly to the downhole tool.

23. The method of claim 19, further including pumping tool fluid from the tool fluid reservoir and towards the downhole tool with a surface pump located at the surface.

24. The method of claim 19, further including sampling the tool fluid from the tool fluid return line with a sample valve in fluid communication with the tool fluid return line.

25. The method of claim 19, wherein the downhole tool is an electrical submersible pump assembly, the tool fluid is a dielectric fluid, and the tool fluid reservoir contains a volume of the dielectric fluid.

26. The method of claim 25, further including providing power to the electrical submersible pump assembly with electrical lines within the conduit extending from the wellhead spool assembly to the downhole tool.

27. The method of claim 25, wherein the electrical submersible pump assembly is free of a protector section.

* * * * *